United States Patent [19]

Sumida et al.

[11] Patent Number: 4,815,724

[45] Date of Patent: Mar. 28, 1989

[54] SHEET FEEDING MECHANISM

[75] Inventors: Yasuji Sumida, Kita Katsuragi; Hiroshi Kajita, Kobe; Koji Ujino, Osaka; Atsushi Kano, Amagasaki; Takashi Maekawa, Osaka; Kiyotaka Shibata, Takatsuki, all of Japan

[73] Assignee: Mita Industrial Co., Ltd., Osaka, Japan

[21] Appl. No.: 16,107

[22] Filed: Feb. 18, 1987

[30] Foreign Application Priority Data

Feb. 28, 1986 [JP] Japan ..... 61-27360[U]

[51] Int. Cl.[4] ..... B65H 5/06; B65H 5/24; B65H 5/36

[52] U.S. Cl. ..... 271/121; 271/124; 271/127; 355/3 R; 355/35 H

[58] Field of Search ..... 271/121, 124, 126, 127, 271/37, 137, 167, 274, 116; 355/3 SH, 14 SH, 3 R

[56] References Cited

U.S. PATENT DOCUMENTS

| | | | |
|---|---|---|---|
| 2,705,636 | 4/1955 | La Bombard | 271/124 |
| 4,032,135 | 6/1977 | Rüenzi | 271/124 X |
| 4,113,245 | 9/1978 | Colglazier et al. . | |
| 4,212,456 | 7/1980 | Rüenzi . | |
| 4,394,009 | 7/1983 | Bergman et al. | 271/124 X |
| 4,535,981 | 8/1985 | Watanabe et al. | 271/124 X |
| 4,572,498 | 2/1986 | Shiozawa . | |
| 4,674,737 | 6/1987 | Murayoshi | 271/124 |
| 4,697,911 | 10/1987 | Kajita et al. . | |

FOREIGN PATENT DOCUMENTS

| | | | |
|---|---|---|---|
| 3328872 | 2/1984 | Fed. Rep. of Germany . | |
| 0135039 | 10/1980 | Japan | 271/124 |
| 0178136 | 9/1985 | Japan | 271/124 |

*Primary Examiner*—A. T. Grimley
*Assistant Examiner*—John G. Smith
*Attorney, Agent, or Firm*—Wenderoth, Lind & Ponack

[57] ABSTRACT

A sheet feeding mechanism includes a receiving member, a feed member for feeding sheets from a stack thereof on the receiving member, and an overlapping feed preventing device including a roller to be rotated in a predetermined direction and a friction member cooperating with the roller. In relation to the friction member, a device is provided for substantially preventing the leading end of a fed sheet from contacting that part of the friction member which is upstream, in the sheet feeding direction, of the nipping site between the friction member and the roller.

2 Claims, 2 Drawing Sheets

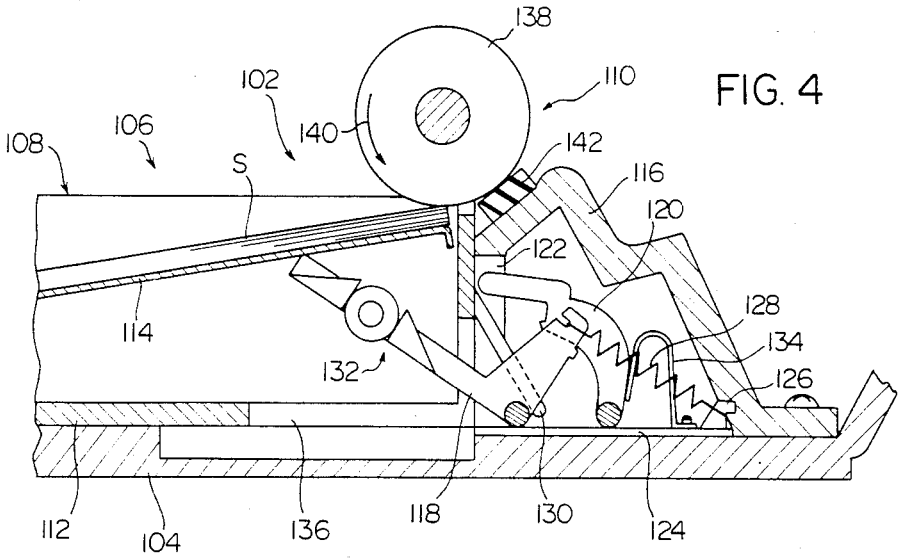
FIG. 4
FIG. 5
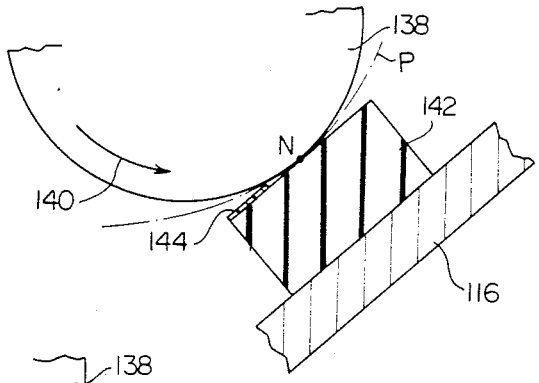
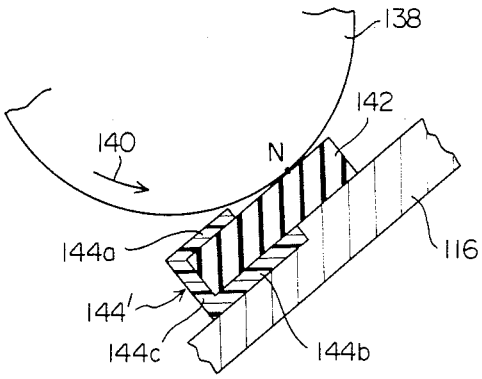
FIG. 6

SHEET FEEDING MECHANISM

FIELD OF THE INVENTION

This invention relates to a sheet feeding mechanism for feeding a stack of sheets one by one from a receiving stand.

DESCRIPTION OF THE PRIOR ART

A sheet feeding mechanism, such as a copying paper feeding mechanism in an electrostatic copying apparatus, has previously come into widespread use. It comprises a receiving stand, a feeding means disposed above the receiving stand, and an overlapping feed preventing means for preventing overlapping feed of sheets from being delivered from the feed means.

A known overlapping feed preventing means is comprised of a roller adapted to rotate in a predetermined direction and a friction member adapted to come into pressing contact with the peripheral surface of the roller.

When the overlapping feed preventing means of the above structure is applied to the sheet feeding mechanism, sheet jamming is likely to occur near the nipping site of the friction member and the roller of the overlapping feed preventing means because the friction member is formed of a material having a high coefficient of friction. Specifically, when the leading end of a sheet delivered from the receiving stand is led to the nipping site between the conveying roller and the friction member, the sheet is usually conveyed toward the downstream side by the action of the roller. However, if the sheet is slightly curled or its delivery direction varies slightly depending upon the number of sheets on the receiving stand, the leading end of the sheet fed from the receiving stand is likely to make direct contact with the surface of the friction member. Since the friction member is formed of a material having a high coefficient of friction, the movement of the leading end portion of the sheet is hampered upon contact, and consequently, the sheet jams up in the nipping site between the roller and the friction member.

SUMMARY OF THE INVENTION

It is an object of this invention to provide a sheet feeding mechanism by which the leading end of a sheet delivered from a receiving stand is led accurately to the nipping site between a roller and a friction member of an overlapping feed preventing means and consequently, a stack of sheets on the receiving stand can be fed accurately one by one.

According to this invention, there is provided a sheet feeding mechanism comprising a receiving member, a feed means for feeding the uppermost sheet of a stack of sheets placed on the receiving member, and an overlapping feed preventing means for preventing the overlapping feed of the sheet fed by the action of the feed means, said overlapping feed preventing means including a roller adapted to rotate in a predetermined direction and a friction member cooperating with the roller, said mechanism further comprising, in relation to the friction member, means for substantially preventing the leading end of the fed sheet from contacting that part of the friction member which is upstream, in the sheet feeding direction, of the nipping site between the friction member and the roller.

BRIEF DESCRIPTION OF THE DRAWINGS

FIG. 4 is a partial sectional view showing an example of applying a second embodiment of the sheet feeding mechanism of the invention to a copying paper feeding mechanism in an electrostatic copying apparatus;

FIG. 5 is a partial enlarged view showing the neighborhood of a nipping site between a roller and a friction member of the overlapping feed preventing means in the paper feeding mechanism of FIG. 4; and FIG. 6 is a partial enlarged sectional view showing on an enlarged scale a part of a modified embodiment resulting from partial improvement of the second embodiment of the sheet feeding mechanism.

DETAILED DESCRIPTION OF PREFERRED EMBODIMENTS

With reference to the accompanying drawings, embodiments of the sheet feeding mechanism constructed in accordance with this invention will be described.

Figure 2:
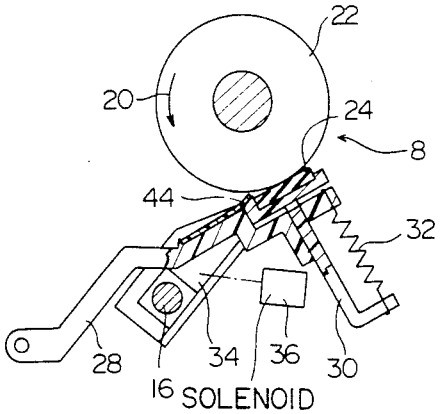
FIG. 2 is a simplified view showing an overlapping feed preventing means in the paper resending mechanism of FIG. 1 as it is in action.
Figure 3:
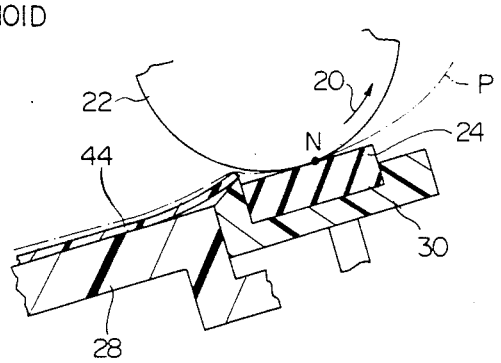
FIG. 3 is a partial enlarged view showing the neighborhood of a nipping site between a roller and a friction member of the overlapping feed preventing means of FIG. 2.

First, the reference to FIGS. 1 to 3, a first embodiment of the sheet feeding mechanism of the invention will be described. In the first embodiment, the sheet feeding mechanism in accordance with this invention is applied to a copying paper resending mechanism in an electrostatic copying apparatus capable of producing a copy on both surfaces of a paper.

Figure 1:
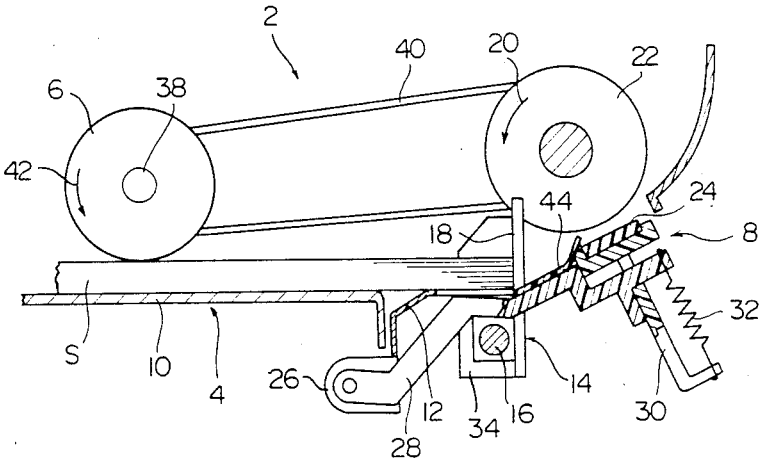
FIG. 1 is a partial sectional view showing an example of applying a first embodiment of a sheet feeding mechanism of the invention to a copying paper resending mechanism in an electrostatic copying apparatus.

With reference to FIG. 1 showing the essential parts of the paper resending mechanism of the electrostatic copying apparatus, the paper resending mechanism 2 acting as a sheet feeding mechanism comprises a paper receiving stand 4 (constituting a receiving member), a feed roller 6 (constituting a feed means) disposed above the receiving stand 4 and an overlapping feed preventing means 8.

The receiving stand 4 has a main plate 10 and a front plate 12, and a stop means 14 is disposed at the front end of the front plate 12. The stop means 14 has a stop piece 18 fixed to a shaft member 16 mounted rotatably, and the top piece 18 is free to move between an operating position (the position shown by solid lines in FIG. 1) at which it hampers the movement of a copying paper (sheet) on the receiving stand 4 and a non-operating position (not shown) at which it permits movement of the copying papers on the receiving stand 4. A copying paper having an image formed on one surface thereof by being conveyed through a copying paper conveying passage (not shown) is received on the receiving stand 4 in the stacked state as shown in FIG. 1.

The overlapping feed preventing means 8 is comprised of a roller 22 adapted to rotate in a direction shown by an arrow 20 and a friction member 24 cooperating with the roller 22. The friction member 24 may be formed of a material having a relatively high coefficient of friction such as a polyurethane rubber. The overlapping feed preventing means 8 is adapted to be held selectively in an operating condition (the condition shown in FIG. 2) in which the friction member 24 acts on the peripheral surface of the roller 22 and a non-operating condition (the condition shown in FIG. 1) in which the friction member 24 is spaced from the roller 22. With reference to FIGS. 1 and 2, a fixture piece 26 is provided in the rear end portion of the front plate 12 of the receiving stand 4, and a rocking arm 28 pivotally mounted on the fixture piece 26. A supporting member 30 is further mounted on the front end portion of the rocking arm 28 so that it is free to move toward and away from the peripheral surface of the roller 22. The friction member 24 is mounted on that surface of the supporting member 30 which faces the roller 22. A spring member 32 for biasing the supporting member 30 toward the roller 22 is intereposed between the front end of the rocking arm 28 and the lower end portion of the supporting member 30. The shaft member 16 is disposed below the arm 28. A rocking member 34 is mounted on one end of the shaft member 16 and is connected to the output terminal of an actuating means 36 (FIG. 2) such as an electromagnetic solenoid. Thus, when the actuating means 36 is deenergized, one side surface, of the shaft member 16 (that is rectangular in cross section) acts on the under surface of the intermediate portion of the rocking arm 28 whereby the overlapping feed preventing means 8 is held in the non-operating condition shown in FIG. 1. On the other hand, when the actuating means 36 is energized, the shaft member 16 rotates through about 45 degrees, and one corner part of the above rectangular cross section acts on the under surface of the intermediate portion of the rocking arm 28. As a result, the rocking arm 28 is pivoted slightly counterclockwise from the position shown in FIG. 1 and the overlapping feed preventing means 8 is held in the operating condition shown in FIG. 2. In the operating condition, the supporting member 30 is biased toward the roller 22 by the action of the spring member 32, and therefore, the friction member 24 is pressed under a predetermined pressure against the peripheral surface of the roller 22 by the elastic biasing action of the spring member 32.

The feed roller 6 is rotatably mounted on a short shaft 38 mounted on a rocking supporting member (not shown). The roller 6 is drivingly connected to the roller 22 via a belt 40, and therefore is rotated in the direction of an arrow 42 by the rotation of the roller 22 in the direction shown by arrow 20. The feed roller 6 is normally in an operating condition in which it acts on copying paper sheets on the receiving stand 4, but when the widthwise positions of the copying paper sheets are to be registered, is held in a non-operating condition at which it is spaced upwardly from the receiving stand.

The structure of the paper resending mechanism 2 is substantially the same as that disclosed in the specification and drawings of Japanese patent application No. 91127/1985 (entitled: ELECTROSTATIC COPYING APPARATUS) filed by the present applicants, and detailed description thereof will be omitted therein.

In the first embodiment, a guide member 44 is further provided in relation to the friction member 24 of the overlapping feed preventing means 8. As will be described hereinbelow, the guide member 44 acts to prevent the leading end of a copying paper fed from the paper receiving stand 4 from contacting that part of the friction member 24 which is upstream, in the paper feeding direction, of the nipping site between the friction member 24 and the roller 22 (the site at which 24 contacts the roller 22). With reference mainly to FIG. 3, the guide member 44 is disposed upstream, in the paper feeding direction, of the nipping site N (FIG. 3) between the roller 22 and the friction member 24 in the above discussed operating condition, and in the embodiment shown, its base portion is fixed to the upper surface of the rocking arm 28. The free end portion of the guide member 44 slightly projects from the upper end of the upstream side portion of the supporting member 30, and extends upwardly in a slightly curved state. The guide member 44 is preferably formed of relatively pliable a material having a relatively low coefficient of friction. For example, it may be formed of a film-like material from a synthetic resin such as Lumilar (tradename). Preferably, as shown in FIG. 3 on an enlarged scale, the guide member 44 is of such a structure that when the overlapping feed preventing means 8 is in the aforesaid operating condition, its free end portion extends slightly upstream, in the paper feeding direction, of the nipping site N of the roller 22.

In the paper resending mechanism 2 described above, the actuating means 36 (FIG. 2) is energized when the copying paper is refed from the paper receiving stand 4 toward the paper conveying passage (not shown). As a result, the overlapping feed preventing means 8 is held in the above operating condition and the stop means 14 is held at a non-operating position. When the roller 22 is rotated in the direction of arrow 20 in such a condition, the feed roller 6 is rotated accordingly in the direction shown by arrow 42. Consequently, the uppermost paper in the paper stack S received in the paper receiving stand 4 is delivered therefrom by the action of the feed roller 6 toward the overlapping feed preventing means 8. The leading end portion of the uppermost paper is thus guided by the upper surface of the guide member 44 and led toward the peripheral surface of the roller 22, and finally contacts that part of the peripheral surface of the roller 22 which is slightly upstream of the nipping site N in the paper feeding direction. Thereafter, this paper is led to the nipping site N between the roller 22 and the friction member 24 by the rotation of the roller 22 in the direction of arrow 20. Such paper undergoes the action of the roller 22 and the friction member 24 to prevent overlapping feed and is fed as shown by a one-dot chain line P in FIG. 3.

Accordingly, the leading end of the paper delivered from the paper receiving stand 4 in the first embodiment does not substantially contact that part of the friction member 24 which is upstream of the nipping site N between the roller 22 and the friction member 24, but accurately contacts the peripheral surface of the roller 22 by being guided by the guide member 44. Thereafter, by the action of the roller 22, the paper is led to the nipping site N between the roller 22 and friction member 24. Hence, paper jamming near the nipping site N can be prevented.

Now, with reference to FIGS. 4 and 5, the second embodiment of the sheet feeding mechanism will be described. In the second embodiment, the sheet feeding mechanism of this invention is applied to a paper feeding mechanism for feeding copying papers to a paper conveying passage in place of the paper resending mechanism.

In FIG. 4 showing the essential parts of the paper feeding mechanism in an electrostatic copying apparatus, a copying paper feeding mechanism 102 acting as the sheet feeding mechanism includes a paper cassette 108 detachably loaded in a cassette-receiving section 106 defined in a housing 104 of the copying apparatus, and an overlapping feed preventing means 110 is disposed above the cassette-receiving section 106.

The paper cassette 108 is provided with a box-like cassette body 112 having an open top, and a paper receiving plate 114 constituting a receiving member is set within the cassette body 112 so that it is free to pivot around its rear end portion as a fulcrum. As shown in FIG. 4, a stack of papers S are placed on the receiving plate 114.

A contact guide member 116 is disposed at the front end of the cassette-receiving section 106, and an L-shaped press-contacting lever 118 and a release lever 120 are pivotably positioned within the contact guide member 116. One end portion of the press-contacting lever 118 projects into the cassette-receiving section 106 through an opening 122 formed in the contacting guide member 116, and a coil spring 128 is interposed between its other end portion and a supporting stand 124 fixed to the housing 104. A free end of the release lever 120 is adapted to project slightly into the cassette-receiving section 106 via the above opening 122. The second embodiment is constructed such that when the paper cassette 108 is removed from the cassette-receiving section 106, the press-contacting lever 118 is held in a non-operating condition by the action of an actuating piece 130 provided in the cassette 108 and a contact portion 132 (formed of a pair of a triangular members and a roller) provided at one end portion of the press-contacting lever 118. In this non-operating condition, one end portion of the press-contacting lever 118 never acts substantially on the paper receiving plate 114 within the cassette 108. When the cassette 108 is loaded in place into the cassette-receiving section 106, the front wall of the cassette body 112 abuts against the free end of the release lever 120 to pivot it slightly clockwise in FIG. 4 against the biasing force of a plate spring 134. As a result, the press-contacting lever 118 is held in an operating condition. In the operating condition, the press-contacting lever 118 is biased clockwise in FIG. 4 by the action of the coil spring 28 as shown in FIG. 4. As a result, one end of the press-contacting lever 118 acts on the under surface of the paper receiving plate 114 via an opening 136 formed in the cassette body 112 to pivot plate 114 upwardly. The copying paper on the paper receiving plate 114 is elastically pressed into contact with the peripheral surface of a roller 138 to be described.

The overlapping feed preventing means 110 is comprised of the roller 138 adapted to be rotated in the direction shown by an arrow 140 and a friction member 142 cooperating with the roller 138. The roller 138 is disposed above the cassette-receiving section 106, and the friction member 142 which can be formed, for example, of a polyurethane rubber is fixed to the upper surface of an upper inclined portion of the contact guide member 116. In the second embodiment, the upper surface of the friction member 142 is adapted to act always on the peripheral surface of the roller 138. It will be seen from FIG. 4 that there is not provided a separate roller which is exclusively used for feeding paper from the paper receiving plate 114, and the roller 138 of the overlapping feed preventing means 110 also acts as a feed means for feeding paper.

The structure of the paper feeding mechanism 102 is substantially the same as that disclosed in the specification and drawings of Japanese patent application No. 197621/1985 (entitled: PAPER FEEDING MECHANISM PROVIDED WITH PAPER CASSETTE) filed by the same applicants as the present application, and details thereof are omitted herein.

In the second embodiment, a protective member 144 is also provided in relation to the friction member 142 of the overlapping feed preventing means 110. The protective member 144 acts to prevent the leading end of a copying paper delivered from the cassette 108 from contacting that part of the friction member 142 which is upstream, in the paper feeding direction, of the nipping site N between the roller 138 and the friction member 142 (the site at which the paper contacts the roller 138). With reference mainly to FIG. 5, the protective member 144 is disposed on that part of the friction member 142 which is upstream of the nipping site N in the paper feeding direction, and in the specific embodiment shown, is fixed to the upper surface of the upstream side of the friction member 142. Preferably, the protective member 144 is formed of a material having a relatively low coefficient of friction. For example, it may be formed of a film-like material prepared from a synthetic resin such as Lumilar (trade name).

When paper is fed from the paper cassette 108 in the aforesaid paper feeding mechanism 102, the roller 138 is rotated in the direction of arrow 140. As a result, the uppermost paper in the paper stack S placed on the paper receiving plate 114 in the cassette 108 is delivered from the paper receiving plate 114 toward the nipping site N (FIG. 5) between the roller 138 and the friction member 142 by the action of the roller 138. It will be understood from FIG. 5 that, since the upstream portion of the friction member 142 beyond the nipping site N is substantially covered with the protective member 144, the leading end of the delivered paper contacts the protective member 144 present on the upstream side of the friction member 142, and is led along the upper surface of the protective member 144 to that part of the peripheral surface of the roller 138 which is slightly upstream of the nipping site N in the paper feeding direction. Then, the paper is led to the nipping site N between the roller 138 and the friction member 142 by the rotation of the roller 138 in the direction of arrow 140. The paper undergoes the action of the roller 138 and the friction member 142 to prevent overlapping feed and is fed to the paper conveying passage (not shown) as shown by a one-dot chain line P in FIG. 5.

Accordingly, in the second embodiment, also the leading end of the paper delivered from the paper receiving plate 114 is led along the upper surface of the protective member 144 provided in the upstream side portion of the friction member 142 and contacts the peripheral surface of the roller 138. Thereafter, the paper undergoes the action of the roller 138 and is led to the nipping site N between the roller 138 and the friction member 142. Hence, paper jamming near the nipping site N can be prevented.

FIG. 6 shows on an enlarged scale a part of a modified embodiment in which the protective member and its related elements in the second embodiment shown in FIGS. 4 and 5 are improved. In the modified embodiment, the protective member 144' is C-shaped and consists of an upper protective portion **144*a*, a lower fixing portion 144*b* and a linking portion 144*c*, and in a recess defined by these members is positioned that part of the friction member 142 which is upstream, in the paper feeding direction, of the nipping site N between the friction member 142 and the roller 138. Hence, in this modified embodiment, the upper protective portion 144*a* of the protective member 144' substantially covers the upper surface of the above upstream portion of the friction member 142. Preferably, the protective member 144'** is also formed of a material having a relatively low coefficient of friction. For example, it may be formed of a synthetic resin or a metal such as stainless steel.

As the protective member 144' has the lower fixing portion **144*b*, a stepped portion for the lower fixing portion 144*b* is formed in the upper surface of the upper inclined portion of the contact guide member 116 so that the under surface of the lower fixing portion 144*b* of the protective member 144' and the undersurface of that part of the friction member 142 which projects from the lower fixing portion 144*b* are fixed in place to the upper surface of the aforesaid upper inclined portion of the guide member 116**.

The other structure of the modified embodiment is substantially the same as the second embodiment, and the modified embodiment produces he same effect as the second embodiment.

While the present invention has been described hereinabove with regard to some preferred embodiments of the sheet feeding mechanism constructed in accordance with this invention, it should be understood that the invention is not limited to these embodiments, and various changes and modifications are possible without departing from the scope of the invention.

For example, the guide member in the first embodiment and the protective member in the second embodiment are used as means for preventing the leading end of a sheet from contacting that part of the friction member which is upstream, in the sheet feeding direction, of the nipping site between the friction member and the roller. The protective member, however, may be used in the first embodiment instead of the guide member, and the guide member may be used in the second embodiment instead of the protective member.

What we claim is:

1. In a sheet feeding mechanism comprising a receiving member for receiving a stack of sheets, a feed means for feeding the uppermost sheet of the stack of sheets from said receiving member, and an overlapping feed preventing means for preventing the feeding of overlapping sheets by said feed means, said overlapping feed preventing means including a roller adapted to rotate in a predetermined direction and a friction member positioned below said roller and cooperating therewith to form a nipping position, the improvement comprising means for preventing any sheet fed from said receiving member by said feed means from contacting the upper surface of said friction member at a position upstream of said nipping position with respect to the sheet feeding direction, said preventing means comprising:

a guide member positioned upstream of said nipping position, said guide member having an upper surface over which moves any sheet fed from the receiving member, said guide member having a downstream end portion extending in a downstream and upwardly inclined direction relative to said upper surface of said friction member, such that the leading end of any sheet fed from said receiving member by said feed means is guided by said guide member to be brought into contact with the peripheral surface of said roller at a position upstream of said nipping position.

2. The improvement claimed in claim 1, wherein said guide member is formed of a material that is relatively pliable and that has a relatively low coefficient of friction.

* * * * *